US005300864A

United States Patent [19]

Allen, Jr.

[11] Patent Number: 5,300,864

[45] Date of Patent: Apr. 5, 1994

[54] PROGRAMMABLE LIGHTING CONTROL SYSTEM

[75] Inventor: Franklin J. Allen, Jr., Pasadena, Calif.

[73] Assignee: Almic Industries, Pasadena, Calif.

[21] Appl. No.: 955,183

[22] Filed: Oct. 6, 1992

[51] Int. Cl.[5] ..... H05B 37/00

[52] U.S. Cl. ..... 315/314; 315/211; 315/324; 315/185 R; 315/294; 315/250; 315/316; 307/115; 307/41; 307/11

[58] Field of Search ..... 307/41, 11, 115; 315/314, 324, 185, 294, 250, 316, 211

[56] References Cited

U.S. PATENT DOCUMENTS 4,215,277 7/1980 Weiner et al. ..... 307/41

5,008,595 4/1991 Kazar ..... 315/250 X

*Primary Examiner*—Robert J. Pascal

*Assistant Examiner*—Haissa Philogene

[57] ABSTRACT

A programmable lighting control system for decorative, artistic, and Christmas lighting applications, includes a plurality of outlet receptacles for connection thereto of series or parallel connected Christmas tree lighting strings or the like, a plurality of associated output select switches to individually select a lighting condition signal for each respective outlet receptacle, timing and control circuitry to generate a plurality of lighting condition signals that are applied to solid-state switching devices to drive the outlet receptacles, an output timing phase synchronization feature initiated at user discretion to synchronize the timing phase of each of the plurality of lighting condition signals, and a memory function to retain the last programmed lighting display conditions of user-selected, entirely unique lighting patterns when using a plurality of lighting strings.

5 Claims, 3 Drawing Sheets

PROGRAMMABLE LIGHTING CONTROL SYSTEM

BACKGROUND OF INVENTION

1. Field of Invention

This invention relates to the control of a plurality of sets of series or parallel connected bulbs used for decorative, artistic, or Christmas lighting applications, and more particularly to that class which provides user-programmability of such a control system.

2. Description of Prior Art

Many patents have been granted for inventions that control the brightness or ON/OFF state of decorative and Christmas tree lighting sets. These inventions describe methods of controlling the amount and/or duration of power applied to the bulbs of a lighting string to vary the brightness or the ON/OFF time of the bulbs.

Some prior inventions of the type described above describe electronic circuitry that, for practical purposes, would be assembled and permanently attached to a fixed number of wires having a fixed number of bulbs to control a plurality of series connected lights, such as described in U.S. Pat. No. 4,890,000, Chou. Other inventions of this type are described as control units with multiple outlets for connecting lighting sets to be controlled by electronic or electromechanical means, which are contained inside the base of the unit, such as U.S. Pat. Nos. 4,125,781, Davis; 4,215,277, Weiner; and 4,678,926, Davis. But previously patented lighting controls of the type cited here do not adequately address the choices and flexibility that today's consumer seeks.

The present invention is a lighting control SYSTEM for control of a plurality of individual sets of series or parallel connected Christmas tree lighting strings, or the like. This system provides incredible flexibility, offering an infinite number of lighting display possibilities. The control unit enclosure houses the electronic circuitry and the controls that are used to program the system for user-selectable lighting display patterns when a plurality of lighting strings are used. The lighting strings connect directly to outlets on the enclosure instead of to outlets attached to some form of extension cord as described in patents cited previously. The approach taken with the present invention places the controls and lighting string connections in close, convenient proximity to one another.

The present invention was conceived and designed to provide the user with a variety of user-selectable lighting patterns to personalize their decorative and Christmas tree lighting displays, while also providing the flexibility to be used year-round for other decorative or artistic lighting applications where two-wire, Christmas tree lighting sets are typically utilized.

Unlike previous inventions where the control unit is limited to a predetermined group of fixed patterns, or when packaged for practical applications control only a fixed number of bulbs, the present invention allows the user to select a blinking rate or ON/OFF state of their choice from a plurality of available lighting condition signals for each individual lighting string, it provides a means for timing phase synchronization of any combination of outlets, provides an ON/OFF memory function that retains user-selected lighting display patterns, and allows for interchangeability of strings having a different number of series or parallel connected bulbs.

SUMMARY OF INVENTION

The primary object of the present invention is to provide a lighting control system for a plurality of individual sets of series or parallel connected Christmas tree lighting strings, or the like, that are individually controlled via a switch means to select various blinking rates or ON/OFF states, and that the timing phase of the selected lighting condition signal of each outlet can be synchronized via a switch means to any other or all other outlets at user discretion to produce completely unique, user-programmable, lighting displays heretofore unobtainable.

Another object of the present invention is to provide a lighting control system, as previously described, that has an ON/OFF memory that allows all outlets to be disabled via a switch means causing all attached lighting strings to extinguish, while the control system retains the last programmed lighting patterns or conditions for all outlets. The ON/OFF memory will retain the last programmed lighting patterns or conditions as long as AC power to the control system is not interrupted, or until the lighting patterns or conditions are changed after the outlets are subsequently enabled.

Yet another object of the present invention is to provide a lighting control system, as previously described, that provides visual indicators for power concerns and appropriate overcurrent protection for the entire control system.

The present invention pertains to a programmable electronic control system that controls a plurality of sets of series or parallel connected lighting strings used for decorative, artistic, or Christmas lighting applications. The control system provides a plurality of outlet means for connection of a plurality of lighting strings. The outlet means are individually controlled via respective individual switch means that independently sequence the available lighting condition signals produced by an internal oscillator and counter/multiplexer circuit for the corresponding outlet means to a user-selected setting. When the outlet means are enabled, the selected lighting condition signal is applied to the gate element of a solid-state switching device which applies or denies power to the corresponding outlet means. The timing phase of the lighting condition signal of any or all of the outlet means may be synchronized via a switch means, while each of the outlet means may have the same or a different signal timing rate. Included in the available lighting condition signals are signals that will constantly energize or de-energize the outlet means, which causes individual lighting strings to be constantly illuminated or extinguished, respectively.

The preferred embodiment of the housing of the control system is a single enclosure with AC wiring means for connection to an AC power source of sufficient rating to operate the control system and to power the said lighting strings. An overcurrent protection means is connected in series with one leg of the AC wiring means of the control system. The switch means for the synchronization function and individual switch means for the outlet means, and the outlet means, are accessible on the exterior of the enclosure. Visual indicators for AC power and the ON/OFF memory function are also on the exterior of the enclosure.

A full-wave rectifier in the control system rectifies the AC power source input and produces a rectified AC signal used to power the outlet means. The rectified AC signal is also used to produce the DC voltage needed to power the electronic circuitry in the control system.

For a more complete understanding of this invention and the objects and advantages thereof, refer to the detailed description and the drawings described below wherein the preferred embodiments of the invention are described and illustrated.

DETAILED DESCRIPTION OF INVENTION

Figure 4:
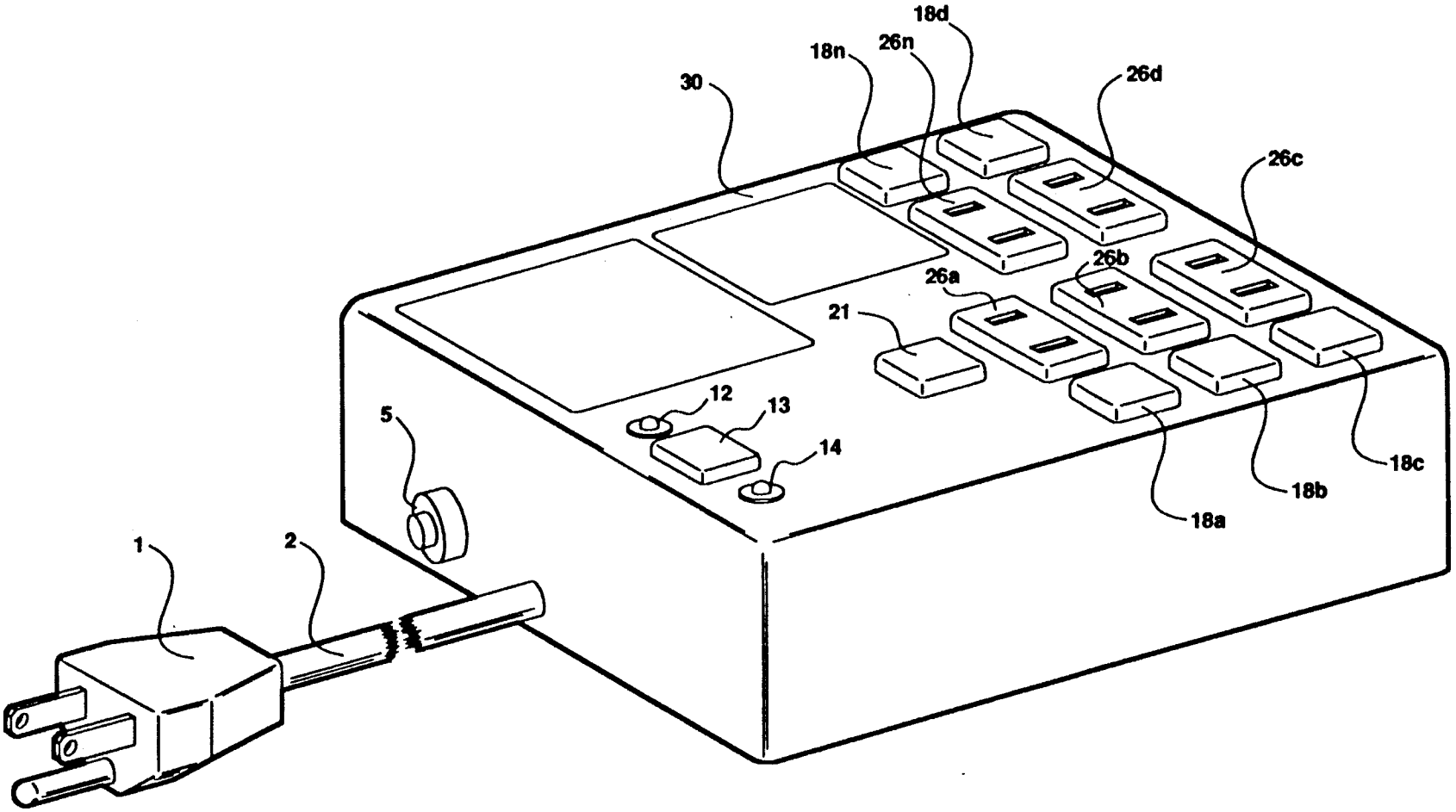
FIG. 4 is a perspective view of the preferred enclosure embodiment of the present invention.

The present invention consists of the preferred embodiments illustrated in FIGS. 1, 2, and 4, which will be described in detail herein. The preferred enclosure embodiment is illustrated in FIG. 4, which houses the circuitry illustrated in FIGS. 1 and 2.

Figure 1:
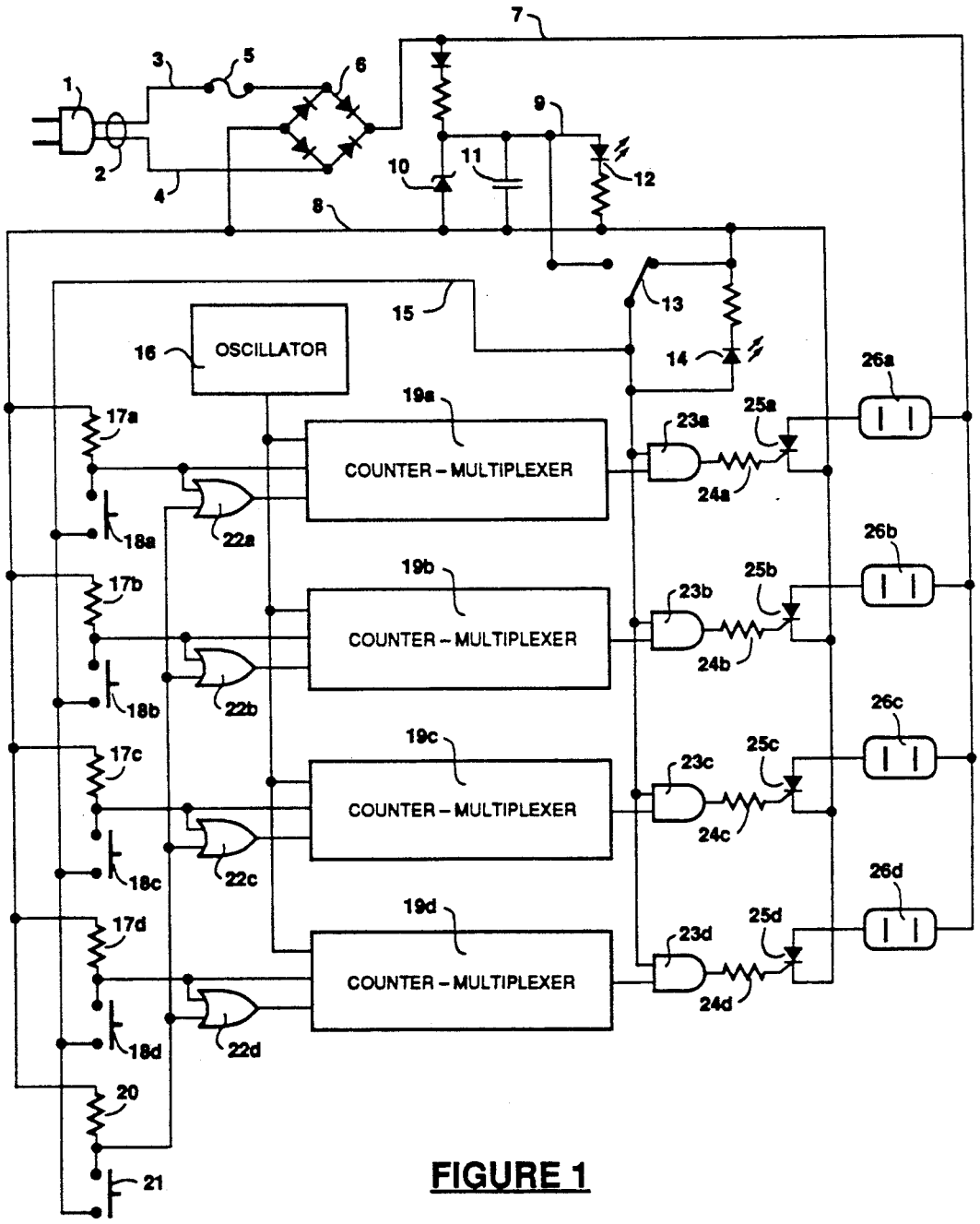
FIG. 1 is a schematic representation of the preferred embodiment of the present invention.

FIG. 1 is a schematic view of the present invention. It consists of an AC input means represented by AC plug 1 and connected to the control system via AC cord 2. An overcurrent protection means 5 is connected in series to AC input 3 and then applied to full-wave rectifier 6. ACC input 4 is also connected to rectifier 6. Rectifier 6 produces a rectified AC source 7 and system circuit ground 8. Rectified AC source 7 is applied in parallel to one contact of two-contact outlets 26*a*–26*d*. System circuit ground 8 is applied throughout the system. The +VDC 9 required to power the electronic components of the system's circuit is established and filtered via zener diode 10 and capacitor 11, respectively.

LED 12 is connected across +VDC 9 and circuit ground 8 to indicate when AC power is applied to the control system and when the DC power required to operate the system is present. LED 14 is connected in parallel with outlet power switch 13 to indicate when power is allowed or denied to outlets 26*a*–26*d* through the gating action of corresponding SCR's 25*a*–25*d*, which enable or disable corresponding outlets 26*a*–26*d* to respond to the respective lighting condition signals generated by the control system.

Outlet power switch 13 is a two-position switch whose contacts are connected one to +VDC 9 and one to circuit ground 8. With the pole of outlet power switch 13 in contact with circuit ground 8, LED 14 extinguishes and a constant logic low is applied to AND gates 23*a*–23*d*, which output a logic low to corresponding current limiting resistors 24*a*–24*d* and is then applied to the respective gate elements of SCR's 25*a*–25*d*. A constant logic low applied to the gates of SCR's 25*a*–25*d* disable outlets 26*a*–26*d*.

With the pole of outlet power switch 13 in contact with +VDC 9, LED 14 illuminates and a constant logic high is applied to AND gates 23*a*–23*d*, which allows lighting condition signals from corresponding Counter/Multiplexer circuits 19*a*–19*d* applied to corresponding AND gates 23*a*–23*d* to pass, and allowing SCR's 25*a*–25*d* to be switched on and off in response to the changing or steady state of the lighting condition signals. The gating action of SCR's 25*a*–25*d* enables outlets 26*a*–26*d* to illuminate and extinguish the respectively connected lighting strings in a manner relative to the lighting condition signals.

Outlet power switch 13 has a dual role; it enables or disables AND gates 23*a*–23*d*, as described previously, and it applies a logic level to output select push buttons 18*a*–18*d* and to synchronization push button 21, which allows or disallows changes to individually selectable lighting condition signals and timing phase synchronization of all lighting signal outputs. When outlet power switch 13 disables AND gates 23*a*–23*d* it also applies a logic low to one contact of push buttons 18*a*–18*d* and 21, via line 15. With a logic low applied to both contacts of push buttons 18*a*–18*d* and 21 as shown in FIG. 1, when push buttons 18*a*–18*d* or 21 are actuated, no change from the previously selected lighting display pattern is registered. For this reason, outlet power switch 13 acts as an ON/OFF memory switch. When switch 13 outputs a logic low, outlets 26*a*–26*d* are disabled and output select push buttons 18*a*–18*d* and sync push button 21 are disabled so that the last programmed lighting display pattern will be retained regardless of multiple actuations of push buttons 18*a*–18*d* or 21 until switch 13 is toggled and produces a logic high to enable the previously disabled gates and switches.

When output power switch 13 enables AND gates 23*a*–23*d*, and consequently outlets 26*a*–26*d*, a logic high is applied to one contact of each of output select push buttons 18*a*–18*d* and synchronization push button 21, via line 15. The other contact of switches 18*a*–18*d* and 21 is connected to a logic low through corresponding pull-down resistors 17*a*–17*d*. The logic low at the switch-resistor junctions is also applied to corresponding Counter/Multiplexer circuits 19*a*–19*d* and to OR gate 22*a*–22*d*, simultaneously. When momentary push buttons 18*a*–18*d* are individually actuated, a logic state transition occurs at the switch-resistor junction and is applied to a corresponding Counter/Multiplexer circuit 19, and to a corresponding OR gate 22. The logic state transition caused by actuating push buttons 18*a*–18*d* sequences the available clock rates and logic states available from corresponding Counter/Multiplexer circuits 19*a*–19*d*. Oscillator 16 generates the base signal clock rate which is applied to all Counter/Multiplexer circuits 19*a*–19*d*, simultaneously. Counter/Multiplexer circuits 19*a*–19*d* use the clock signals to produce various lighting timing rates.

Figure 3:
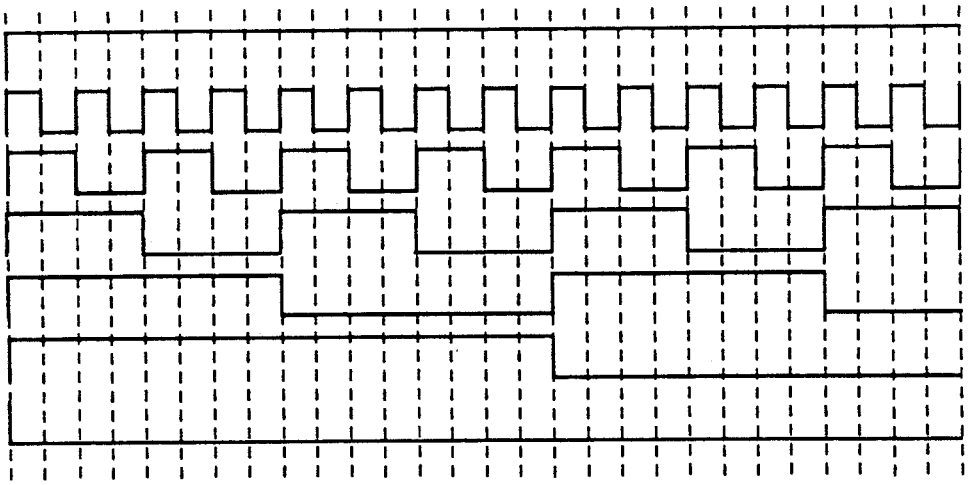
FIG. 3 is an example of the possible timing relationship between the lighting condition signals of the preferred embodiment.

The output of Counter/Multiplexer circuits 19*a*–19*d* are applied to corresponding AND gates 23*a*–23*d*. When a logic high from switch 13 is applied to the second input of AND gates 23*a*–23*d*, the output from Counter/Multiplexer circuits 19*a*–19*d* passes through corresponding AND gates 23*a*–23*d* to corresponding current limiting resistors 24*a*–24*d*. This current limited signal is applied to the gate elements of corresponding SCR's 25*a*–25*d*. The anode of SCR's 25*a*–25*d* are connected individually to one contact of a corresponding two-contact outlets 26*a*–26*d*. The opposite contact of outlets 26*a*–26*d* are connected in parallel to a rectified AC source described previously. The cathode of SCR's 25*a*–25*d* are connected in common to circuit ground. The gating of SCR's 25*a*–25*d* applies or denies power to its corresponding outlet 26*a*–26*d* relative to the lighting condition signal applied to each SCR. An example of the contemplated clock rate relationships and logic states for the present invention are illustrated in FIG. 3.

Therefore, as each output select push button 18 is actuated, the corresponding output is sequenced through a series of lighting condition signals. The contemplated individual lighting options include a steady-on condition, a steady-off condition, and a plurality of clock rates for each individual outlet 26. Each outlet 26 is individually controlled. At the same moment an output select push button 18 is actuated, the timing phase of that particular output clock rate is changed via a simultaneous input to a corresponding OR gate 22, whose output is connected to the clock counter reset input illustrated in FIG. 2.

While the timing phase of each individual output is dependent on the actuation of its corresponding output select push button 18, the timing phase of any combination of outputs can be synchronized by the actuation of a single push button. Synchronization push button 21 sets the timing phase for all Counter/Multiplexer circuits 19*a*–19*d*, simultaneously. Even if the clock rate of the lighting condition signal of each output is different, the timing phase between any or all of them will be established at the same point. But, by subsequently actuating an individual output select push button 18, the timing phase of the corresponding output will be out of phase in relation to the previously synchronized outputs.

Figure 2:
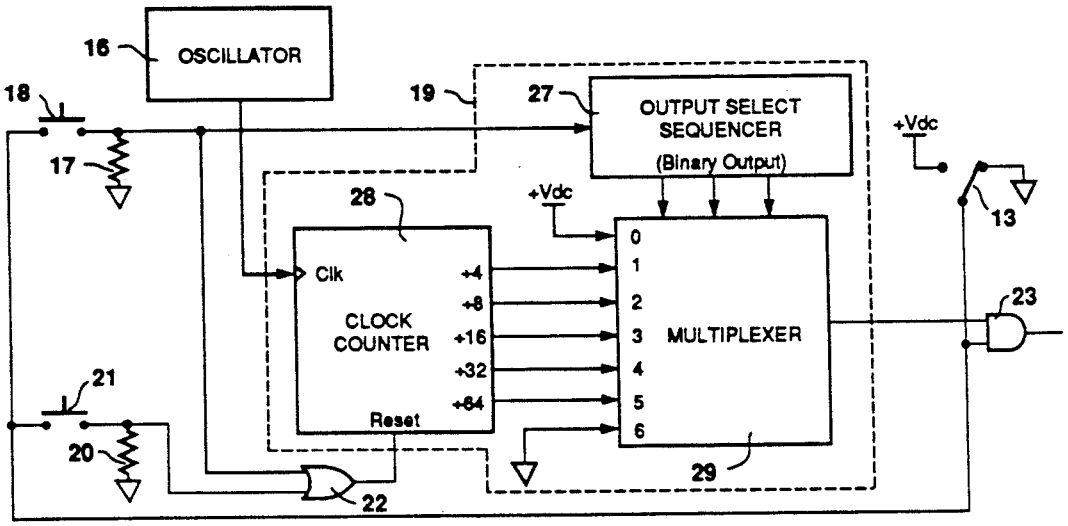
FIG. 2 is a schematic representation of a single Counter/Multiplexer circuit referred to in FIG. 1.

Counter/Multiplexer circuit 19 illustrated in FIG. 2 is common to each output select push button 18 and each outlet 26. All Counter/Multiplexer circuits 19*a*–19*d* of FIG. 1 receive clock pulses simultaneously from oscillator 16, and each is affected simultaneously by synchronization push button 21. Counter/Multiplexer circuit 19 consists of output select sequencer 27, clock counter 28, and multiplexer 29. FIG. 2 illustrates the relationship between the switches and the circuitry of a single Counter/Multiplexer circuit 19. The description here applies to each such circuit.

As previously described, when outlet 26 is enabled, push buttons 18 and 21 are also enabled. One contact of output select push button 18 is connected to OR gate 22 and to output select sequencer 27 of Counter/Multiplexer circuit 19. When push button 18 is actuated, a binary output from the sequencer is applied to multiplexer 29 to select a single output from a plurality of inputs to multiplexer 29. As illustrated in FIG. 2, inputs to multiplexer 29 consist of one logic high, one logic low, and five clock signal inputs from clock counter 28. Clock counter 28 is continually fed clock pulses from oscillator 16. Clock counter 28 divides the clock input into predetermined frequencies for a plurality of clock outputs. All clock counter 28 outputs and the logic level states are simultaneously applied to multiplexer 29. Multiplexer 29 outputs a lighting condition signal based on the binary input from output select sequencer 27, which is incremented by actuations of push button 18. The output of multiplexer 29, which could be a steady logic state or a timing signal, is applied to one input of AND gate 23. The other input to AND gate 23 is from switch 13, which enables or disables AND gate 23, as previously described. When push button 18 is actuated, it simultaneously resets clock counter 28 via OR gate 22. The individual timing phase of the lighting condition signal is established based on the physical actuation of push button 18 if the lighting condition signal is one of the clock rate signals. However, push button 21 may be used to change the timing phase of even a single lighting condition signal, if desired, without sequencing the present lighting condition signal of that particular outlet.

FIG. 4 illustrates the preferred enclosure embodiment 30 of the present invention. Accessible on the exterior of the control system enclosure is intended the plurality of outlets 26 and a plurality of corresponding output select push buttons 18. Also accessible on the exterior of the enclosure is the synchronization push button 21, outlet power switch 13, AC power LED 12, outlet power LED 14, overcurrent protection 5 reset access, and AC power cord set 1 and 2.

The flexibility of the present invention provides a means for the creation of personally unique lighting display patterns using a plurality of Christmas tree lighting strings, or the like, whose individual lighting condition signals may be individually selected for any of the lighting conditions available within the control system.

Although FIG. 1 shows only four outlets, any number of outlets with a corresponding number of output select push buttons and corresponding associated electronic circuitry is possible within the scope of the present invention. Outlet 26*n* and output select push button 18*n* of FIG. 4 represent an unspecified number of outlet possibilities. In fact, the present invention is based on and has been described as having a plurality of similar components, circuitry, and hardware to satisfy its intended purpose.

While modifications of the circuit illustrated and described here may be accomplished by those skilled in the art, such as varying switch means, different indicator means, modernizing circuit packaging, and logic gate applications, the true spirit of the present invention can be found in the following claims. Various alternate means of performing functions described here have been contemplated and will be covered in appropriate form in the following claims.

What is claimed is:

1. A lighting control device for the control of a plurality of sets of series or parallel connected lighting strings providing individual lighting condition selection for individual said lighting strings comprising an AC input means, an AC rectifier, a plurality of outlet means, a plurality of solid-state switching means, a plurality of output select means, an output enable/disable means, a program memory means, an output timing phase synchronization means, power indicator means, an overcurrent protection means, and associated control circuitry; said AC input means comprising an AC plug and electrical conductors applies AC to said AC rectifier means to produce voltages to operate said control circuitry and to power said plurality of outlet means; said control circuitry generates timing pulses and logic levels used to control the on/off time and brightness of said lighting strings connected to said outlet means; said plurality of outlet means each having two contacts one of said contacts of each outlet being bussed to one of said contacts of all other said outlet means and to a common voltage source; said plurality of outlet means each having a second of said contacts that are separately and individually connected to one of two main terminals of one each of said plurality of solid-state switching means; said plurality of solid-state switching means each having a second of said main terminals that are connected in common to a system ground bus; said plurality of solid-state switching means each having a gating element to switch on and off or vary the current flow through the respective said solid-state switching means in response to selected signals applied respectively to each of said gating elements of each of said plurality of solid-state switching means; said output enable/disable means provides at least one logic level transition to said control circuitry to cease lighting action of all said lighting strings connected to said outlet means; said program memory means provides at least one logic level transition to said control circuitry and in turn to said plurality of output select means and said output timing phase synchronization means in conjunction with said output enable/disable means to temporary disallow subsequent changes to previously selected lighting conditions until an appropriate logic level transition is applied to said control circuitry to allow for the desired lighting changes; said plurality of output select means individually and independently provides at least one logic level transition at user discretion to said control circuitry to advance the available lighting condition signal produced by said control circuitry for a respective said solid-state switching means to apply and/or deny power to the respective said outlet means relative to the said lighting condition signal selected; said output timing phase synchronization means provides at least one logic level transition at user discretion to said control circuitry to simultaneously establish the timing phase for all of said lighting condition signals controlling all said lighting strings connected to the said plurality of outlet means.

2. The lighting control device claimed in claim 1 wherein a first said power indicator means is provided for a visual indication of AC power presence and DC power presence within the said lighting control device.

3. The lighting control device claimed in claim 1 wherein a second said power indicator means is provided for a visual indication of power availability or absence controlled at user discretion by a switch means for the said outlet means of the said lighting control device.

4. The lighting control device claimed in claim 1 wherein said overcurrent protection means to provide reasonable protection of said lighting control device from damage and to reduce fire hazard in case of internal part failures or in case an extreme load is applied to any of said plurality of outlet means.

5. The lighting control device claimed in claim 1 wherein a plurality of said outlet means is accompanied by an equivalent number of said plurality of output select means and a plurality of identical associated circuitry for each.

* * * * *